US005412926A

United States Patent [19]

Focke

[11] Patent Number: 5,412,926

[45] Date of Patent: May 9, 1995

[54] PROCESS AND APPARATUS FOR REJECTING DEFECTIVE PACKAGES IN THE REGION OF A PACKAGING MACHINE

[75] Inventor: Heinz Focke, Verden, Germany

[73] Assignee: Focke & Co. (GmbH & Co.), Verden, Germany

[21] Appl. No.: 35,792

[22] Filed: Mar. 23, 1993

[30] Foreign Application Priority Data

Mar. 24, 1992 [DE] Germany ..... 42 09 454.2

[51] Int. Cl.[6] ..... B65B 11/00; B65B 49/00; B65B 57/00

[52] U.S. Cl. ..... 53/466; 53/53; 53/228; 53/232

[58] Field of Search ..... 53/53, 54, 466, 228, 53/230, 231, 232, 377.3, 376.4, 377.6, 491

[56] References Cited

U.S. PATENT DOCUMENTS

| | | | |
|---|---|---|---|
| 2,922,519 | 1/1960 | Radley | 53/53 |
| 3,344,578 | 10/1967 | Anderson . | |
| 3,507,089 | 4/1970 | Mizelle et al. | 53/230 X |
| 3,803,967 | 4/1974 | Leavens | 53/53 X |
| 3,956,110 | 5/1976 | Seragnoli | 53/53 X |
| 3,956,869 | 5/1976 | Seathar et al. | 53/53 |
| 4,349,998 | 9/1982 | Covert . | |

FOREIGN PATENT DOCUMENTS

| | | |
|---|---|---|
| 272337 | 12/1986 | European Pat. Off. . |
| 330495 | 2/1989 | European Pat. Off. . |
| 2494217 | 5/1982 | France . |
| 3635722 | 5/1987 | Germany . |
| 3801388 | 7/1988 | Germany . |
| 3833390 | 5/1989 | Germany . |

*Primary Examiner*—Linda B. Johnson
*Attorney, Agent, or Firm*—Sughrue, Mion, Zinn, Macpeak & Seas

[57] ABSTRACT

A process and an apparatus for rejecting defective packages in the region of a packaging machine are disclosed. In the production of bundles formed from several individual packages, especially from a group (11) of cigarette packages (10), it is required to inspect the cigarette packages (10) as regards completeness of the group. Packages (13) which are thus found to be defective are marked in an exteriorly visible manner and are rejected at a later stage, especially in the region of a discharge track (26). The defective package (13) is marked by way of folding over a folding tab of an outer wrapping (12), especially a lower tab (33) in the region of a rearward side wall with respect to the conveying direction. The lower tab (33) forms a gusset (36) which is folded over to the outside.

12 Claims, 6 Drawing Sheets

Figure 1:
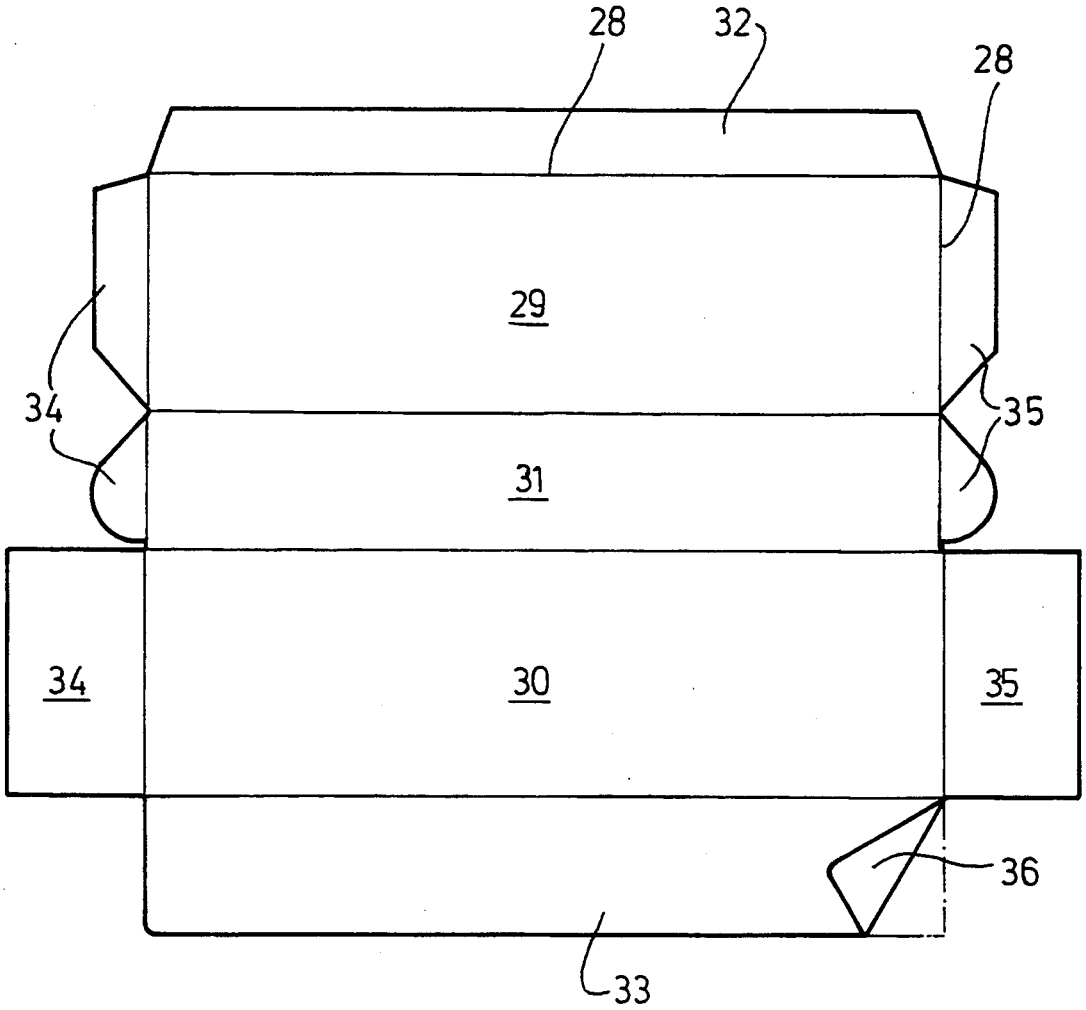

PROCESS AND APPARATUS FOR REJECTING DEFECTIVE PACKAGES IN THE REGION OF A PACKAGING MACHINE

DESCRIPTION

The invention relates to a process for rejecting packages which are defective with respect to their contents (defective packages) from a feed stream of the packages in the region of a packaging machine, especially in conjunction with the production of bundles for cigarette packages (so-called cigarette cartons). Furthermore, the invention relates to an apparatus for carrying out this process.

During the production of large packages—bundles—formed from a group of small packages, especially cigarette packages, it is quite often unavoidable that a group of small packages which is assembled to form the package contents is incomplete. These large packages which are defective with respect to their contents, i.e. with respect to the number of wrapped small packages, must be identified and rejected.

Bundles of cigarette packages are usually delivered in rows, each formed from two superposed cigarette packages. This line of packages is separated into appropriate groups of usually ten cigarette packages which are to form the contents of a bundle. For various kinds of reasons, there are quite often gaps in the line of packages which result in the production of bundles with incomplete contents.

The invention is based on the object of proposing measures which permit an inspection of the package contents of a (large) package—bundle—without impeding the manufacturing process, and a simple and reliable identification and rejection of defective packages.

To attain this object, the process according to the invention is characterized in that the package contents, especially a group of cigarette packages, is inspected after assembly of the group immediately before or during the packaging process at a time when the package is at least still partially open, and in that a defective package is provided with a visible exterior marking, and in that the package which is marked in this way is rejected thereafter, especially in the region of a discharge track for the completed packages.

Accordingly, the process according to the invention comprises three steps: First of all, the correctness of the package contents, i.e. of the group of small packages, especially cigarette packages, is inspected. If there are any faults, the package is marked. Later, after the packages have been finished, the defective package is identified and rejected.

According to the invention, the visible marking of a defective package consists of a marking which is applied to the package, specifically to the outer wrapping of the package, in the course of the packaging process. In the preferred exemplary embodiment of the invention, this marking is formed from a folding tab of the outer wrapping which is folded over especially in the region of a corner. In outer wrappings of cigarette cartons which are formed from thin cardboard, an outer closure tab in the region of an elongated side wall is particularly suitable for this purpose. An essentially triangular gusset which is turned inside out is formed by folding over a marginal corner portion.

The package is inspected just before it is wrapped, especially in the region of a folding station. Here, an inspection means inspects the package in the region of its rear side which is still open. The arrangement of the small packages within the group of packages permits the inspection of all cigarette packages in the region of a longitudinal side which is the rearward side with respect to the direction of transport, preferably by means of a camera.

Defective packages are rejected outside the region in which the folding and other processing operations are carried out, particularly in the region of a discharge track.

Figure 2:
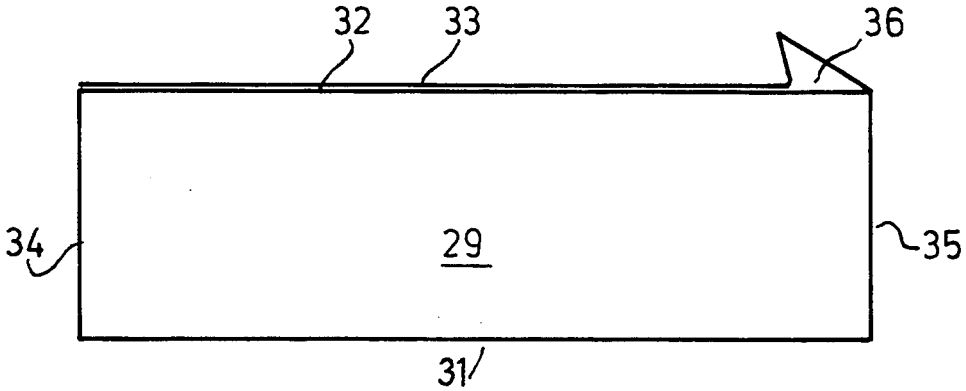
Figure 3:
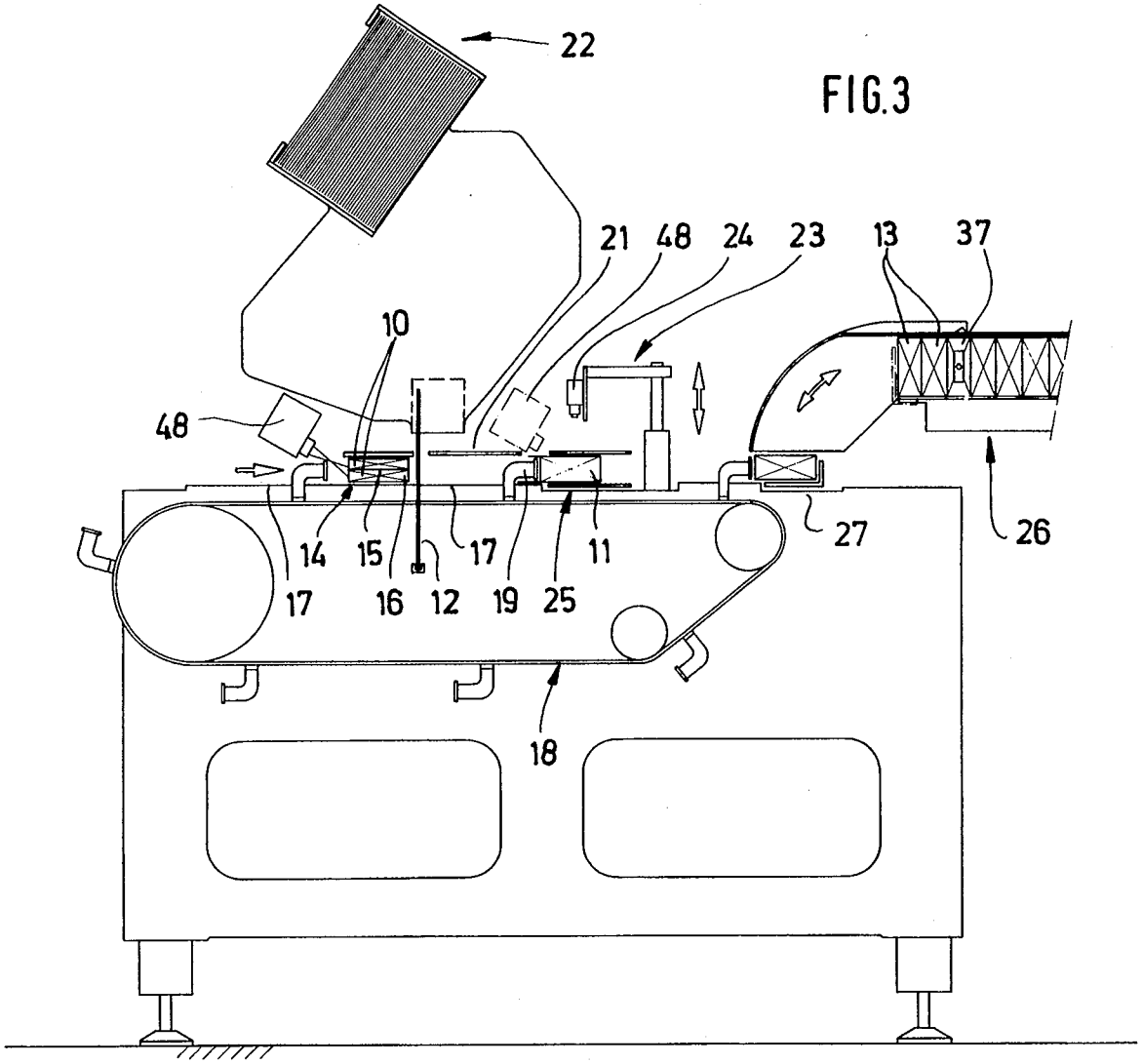
Figure 4:
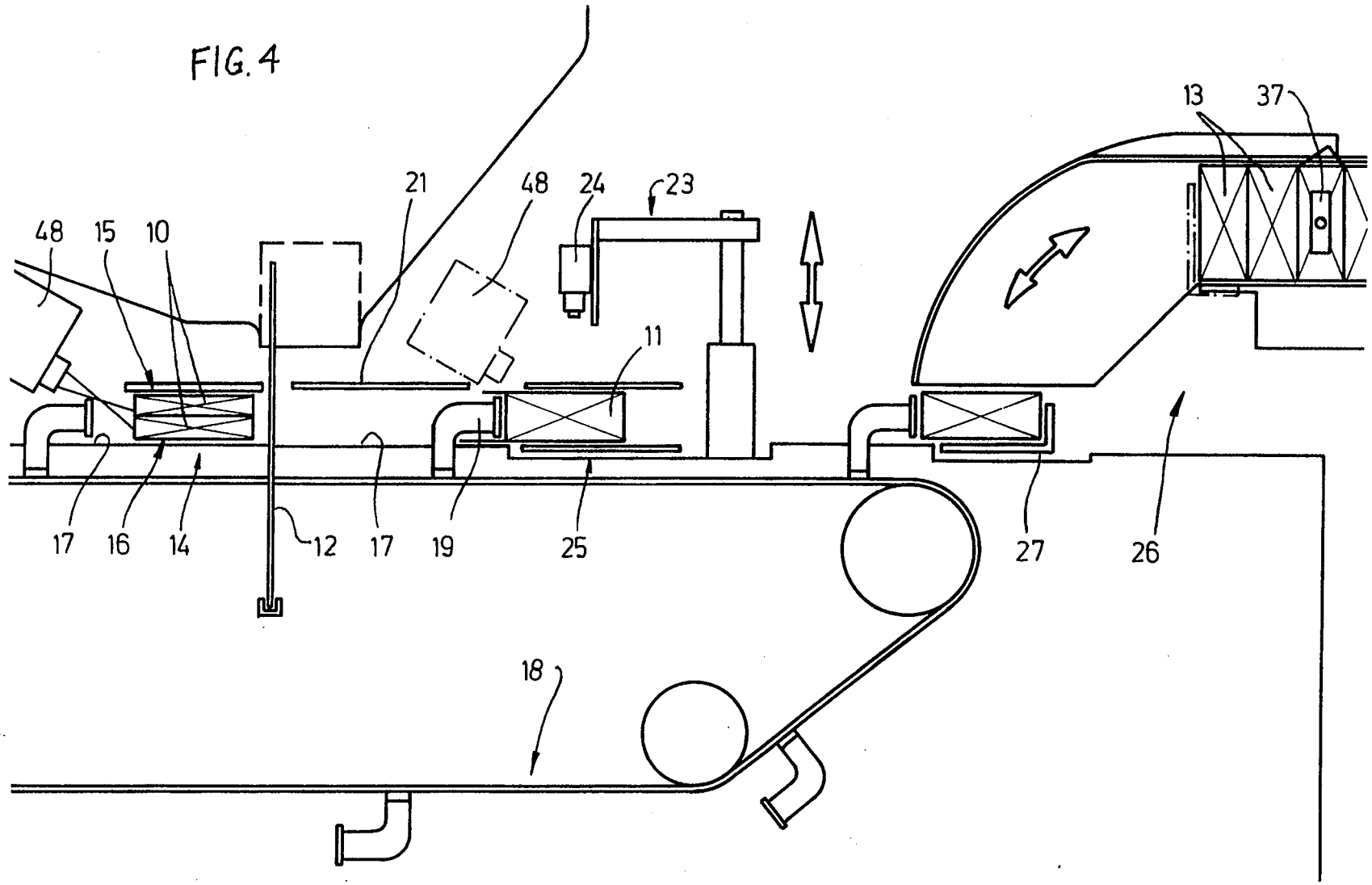
Figure 5:
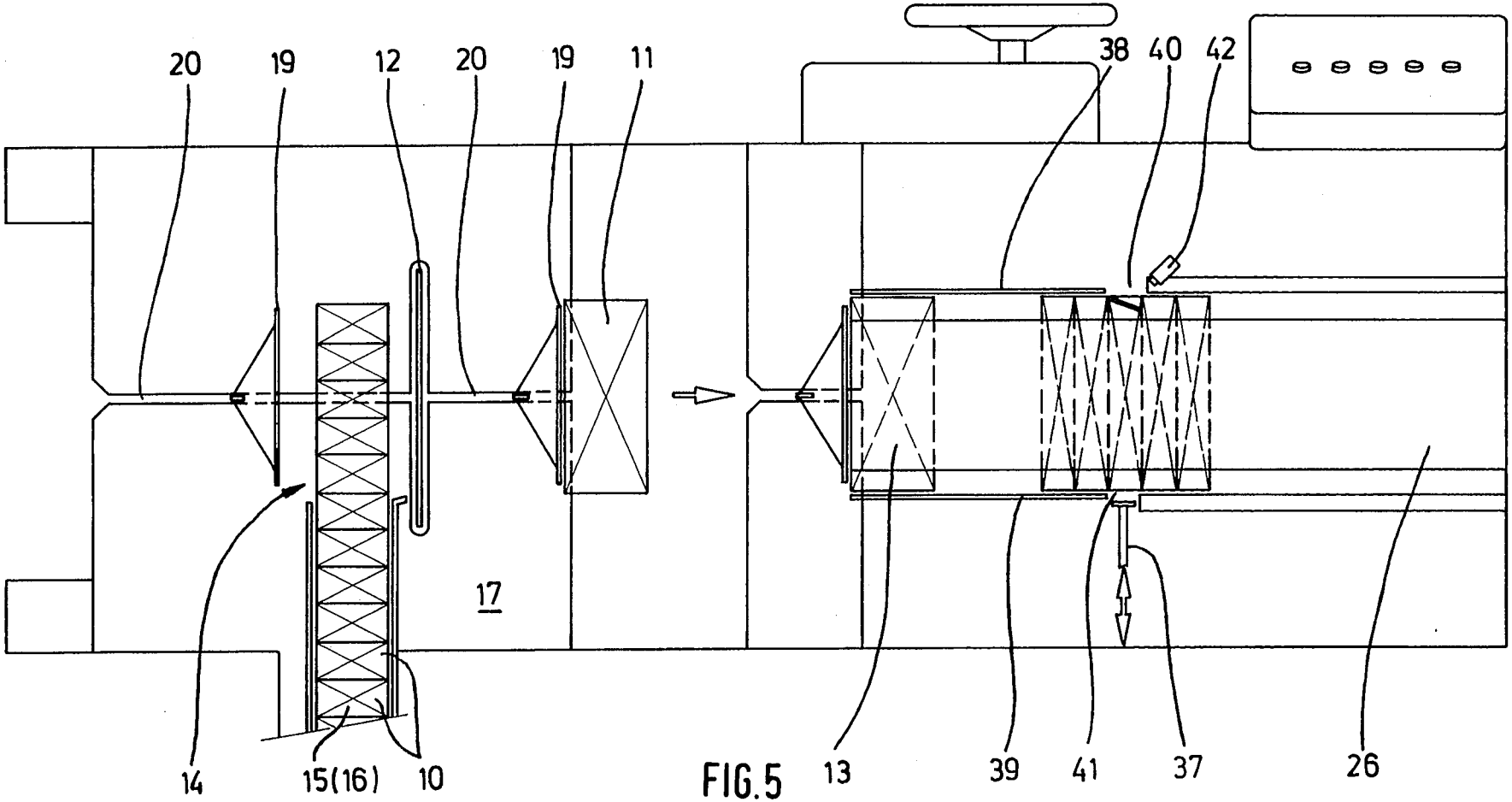
Figure 6:
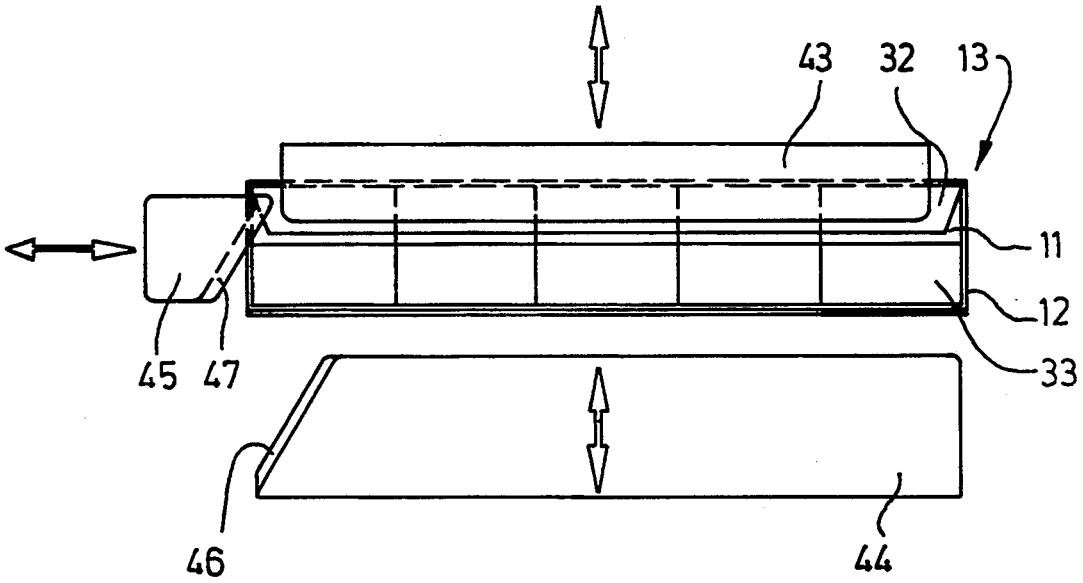
Figure 7:
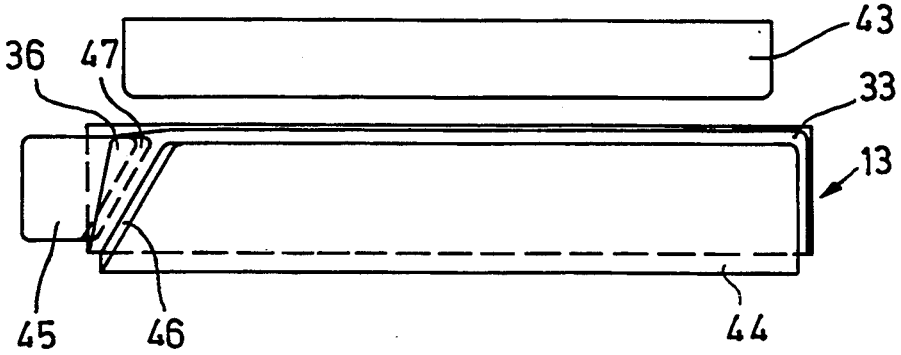
Figure 8:
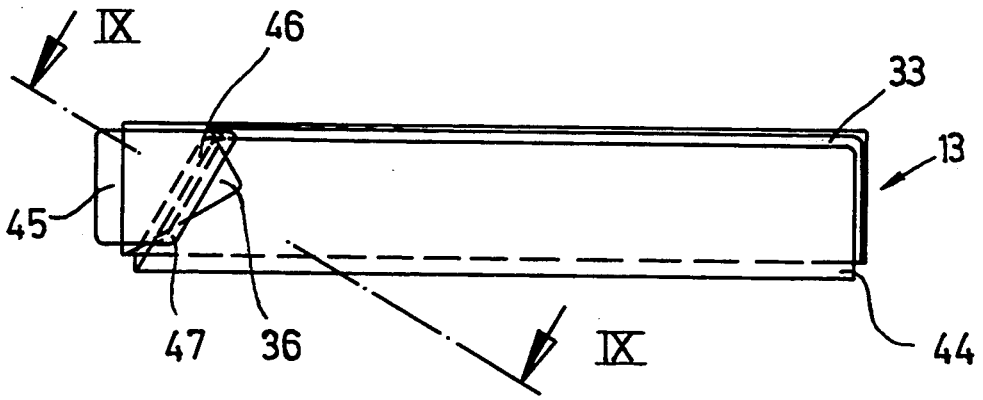
Figure 9:
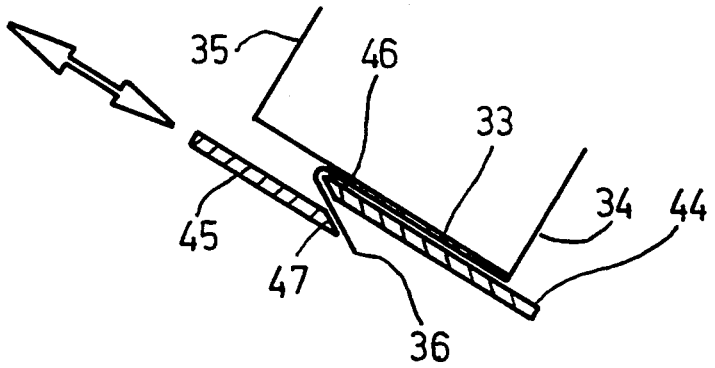

Further features of the invention relate to the structure of the apparatus. An exemplary embodiment will be described hereinafter, in detail, with reference to the drawings, in which:

FIG. 1 shows an unfolded blank for a package, specifically for a bundle,

FIG. 2 shows a schematic plan view of a ready-folded package with a marking, FIG. 3 shows an apparatus, in particular a fragmentary schematic side view of a packaging machine, FIG. 4 shows an enlarged fragmentary view of the apparatus of FIG. 3, FIG. 5 shows a plan view of the apparatus of FIG. 3, that is to say parts thereof, FIG. 6 shows enlarged details of a folding unit for the marking of a defective package, FIG. 7 shows the detail of FIG. 6 during the folding process, FIG. 8 shows the detail of FIGS. 6 and 7 at a later stage in the folding process, FIG. 9 shows an enlarged section taken on the line IX—IX of FIG. 8.

The exemplary embodiment illustrated in the drawings is directed to the production or forming of bundles from a plurality of cigarette packages 10. A group 11 of cigarette packages 10 is packaged in an outer wrapping 12 which is, in this case, made of thin cardboard. A (large) package 13 which is produced in this manner forms a bundle, which is also called a cigarette carton if the bundle is formed from cigarette packages 10.

The cigarette packages 10 are delivered in the form of a continuous package line 14 which is comprised of two superposed rows 15, 16 of cigarette packages 10 which are in alignment relative to one another. The package line 14 leads to a table board 17. In the region of this table board, a group 11 which corresponds to the package contents is pushed off from the package line 14. For this purpose, a group conveyor 18 is disposed below the table board 17. This group conveyor is an endless conveyor having a plurality of drive members 19 which pass through a longitudinal slit 20 in the table board 17 and engage the rear side of a group 11.

The group 11 which is conveyed onto the table board 17 is fed to a blank of the outer wrapping 12. This blank is held ready in an upright plane directed transversely relative to the conveying direction of the group 11. The group 11 is conveyed through the plane of the outer wrapping 12, whereby the outer wrapping wraps itself around the group 11. For this purpose, a top guide 21 is disposed above the table board 17 and forms a mouth piece orifice together with the table board 17 for the U-shaped folding of the outer wrapping 12 when the group 11 is transported into the region of the top guide 21, thereby taking along the outer wrapping 12. The blanks for the outer wrapping 12 are extracted from a magazine 22.

In a following folding station 23, the outer wrapping 12 is folded in the region of laterally directed end faces which extend parallel to the direction of transport, and in the region of the rearward side with respect to the direction of transport. For this purpose, different kinds of known folding means 24 are provided. These folding steps are carried out in the region of a folding platform 25 which is appropriately adapted for this purpose.

The finished packages 13 are then fed to a discharge track 26. For this purpose, the group conveyor 18 places the packages 13 on a transfer conveyor 27 which is formed from an angle section. The transfer conveyor 27 is moved together with the packages 13 through a quarter circle, thereby turning the package 13 by 90°, so that the package stands upright in the region of the discharge track 26.

The exemplary embodiment described above is directed to the handling of cuboid elongated (bundle) packages 13 having an outer wrapping 12 made of thin cardboard. A blank for this wrapping 12 is illustrated in FIG. 1. The blank is divided by means of folding lines 28 into individual fields for forming package walls. A large-surfaced rectangular top wall 29, a corresponding bottom wall 30 and an intermediate elongated side wall 31 are thus formed. An opposite side wall of corresponding dimension is formed from two closure tabs which overlap one another in the closed position, in particular from a smaller upper tab 32 and a greater lower tab 33 which covers the entire side wall. In the closed position, the lower tab 33 is usually located on the outside, whereas the narrower upper tab 32 is inserted between lower tab 33 and package contents in the form of an insertion flap.

End wall tabs 34, 35 of different designs are located at the sides of the blank in order to form small-surfaced end walls.

A portion of the outer wrapping 12 which is located on the outside with a marginal or corner region is modified visibly by way of being folded over in order to mark a defective package. In the described exemplary embodiment, the outward lower tab 33 in the region of a side wall serves for the marking of a defective package. A corner portion of the lower tab 33 which is directed towards the one end wall of the package is folded outwardly, such that an almost triangular gusset 36 is turned outside so as to expose the inner side of the packaging material. This marking makes it easy to identify the defective package.

As described in the foregoing, the rejection of a defective package takes place in the region of the discharge track 26. Here, a pusher 37 is disposed laterally next to the discharge track 26. This pusher engages an end wall of the defective package and ejects this package transversely relative to the conveying direction. A side boundary 38, 39 of the discharge track 26 is provided with a recess 40, 41 through which the pusher 37 and the defective package 13 can pass.

The packages 13, which are transported tightly next to one another in the region of the discharge track 26, are oriented such that their closed side wall 31 faces downwards and, accordingly, their side wall formed from the upper tab 32 and the lower tab 33 faces upwards. The marking (gusset 36) which is applied to the lower tab 33 can thus be identified on the top side. For this purpose, an inspection means, specifically an optoelectric sensor 42 which controls the pusher 37 is disposed in the vicinity of the pusher 37.

The gusset 36 is applied to the package in the region of the folding station 23. For this purpose, a folding unit which is illustrated in FIGS. 6 to 9 acts upon the rear side of the package 13 with respect to the conveying direction. This folding unit is formed from an elongated and rail-like upper folding member 43 which folds over the upper tab 32 from the rearwardly directed horizontal position (FIG. 4) until it contacts the rear side of the package contents. For this purpose, the upper folding member 43 can be moved up and down.

The lower tab 33 is folded over by a lower folding member 44 which is disposed below the folding platform 25. This lower folding member also takes the form of an elongated section and can be moved up and down, whereby it takes a long the lower tab 33 during the upward movement.

The lower folding member 44 operates in association with a corner folding member 45 in order to form the marking, that is to say in order to fold the gusset 36. This corner folding member also takes the form of a flat section and is movable to and fro in the horizontal direction. An end portion of the lower folding member 44 which is directed towards the corner folding member 45 is provided with a sharpened inclined folding edge 46. This folding edge interacts with a corresponding inclined folding edge 47 of the corner folding member 45 which folding edge 47 is sharpened on the opposed side. Lower folding member 44 and corner folding member 45 are movable in offset planes (FIG. 9) and over lap one another partially during the folding of the gusset 36.

To fold the gusset 36, the lower folding member 44 is first of all moved upwards, thereby taking along the lower tab 33. At the same time, the corner folding member 45 is moved from a retracted position transversely, namely horizontally. Before the lower folding member 44 reaches the final position with the lower tab 33, namely in an inclined position of the lower tab 33, the free edge of the lower tab 33 in the region of the folding edge 46 is engaged by the corner folding member 45 and folded over against the outer side of the lower folding member 44 as the folding means continue their movements (FIG. 9). In the meantime, the lower folding member 44 has reached the upper end position and has moved the lower tab 33 into the proper (closing) position of the package. Thus, a visible marking is applied to the package 13.

The completeness of the package contents, i.e. the group 11, is inspected after the group 11 has been formed. The inspection can take place before the group 11 receives the outer wrapping 12. However, it is more advantageous if the inspection is carried out as late as possible, i.e. just before the package 13 is closed in the region of the folding platform 25. Here, the entire group 11 can be monitored in the region of the rear side as long as upper tab 32 and lower tab 33 are still located in the horizontal position.

The group 11 of packages is preferably inspected by optical inspection means, specifically cameras 48. Preferably, such a camera 48 is disposed in the region of the folding platform 25 above the path of movement of the packages 13. A lens is directed to the (open) rear side of the package such that it points down from above at an angle.

What is claimed is:

1. A process for production of packages (13), wherein a group (11) of individual cigarette packs (10) is surrounded by an outer wrapper (12) to form a package, and wherein groups of said individual packs are conveyed in a forward conveying direction, said process comprising the following steps:

a) forming each group (11) to consist of at least one row of individual packs (10) and to extend transversely relative to said conveying direction of the groups (11);

b) transporting the group (11) on a support (17), such that a blank for an outer wrapping (12), which blank is held ready in a plane located transverse relative to said conveying direction, is folded around the group (11) in a U-shaped manner, and taken along with the group (11);

c) inspecting the group (11), with respect to a complete number of individual packs in the group (11), by at least one contactless inspection means (48) that is directed towards a rearward face of the group (11), which face extends transversely relative to said conveying direction, and which is formed from faces of all the individual packs of the group (11);

d) if the group (11) is incomplete, identifying the package as defective and causing the inspection means to generate an error signal which subsequently causes the defective package (13) to be provided with a marking which is visible from outside the package;

e) rejecting a defective, marked package (13) from a feed stream in a region of a discharge track (26); and f) in the package (13) which is identified as being defective, providing the outer wrapping (12) with the visible marking by folding over a portion of an outer lower folding tab (33) of the outer wrapping, said folding tab (33) being located outside in a complete package (13).

2. A process for the production of packages (13) from a group (11) of individual cigarette packs (10) which are surrounded by an outer wrapping (12), wherein groups of said packs are transported in a transport direction, said process comprising the following steps:

a) making the outer wrapping (12) from cardboard;

b) assembling the individual packs (10) into a group (11) to form the contents of a package (13), and then wrapping the group (11) in the outer wrapping (12);

c) immediately before or during the wrapping step, at a time when the package (13) is at least still partially open, inspecting the group for a complete number of individual packs therein;

d) identifying as a defective package a package which contains fewer than said complete number of packs, and providing the defective package with a visible exterior marking during the wrapping step by folding over a portion of an outer lower folding tab (33) of the outer wrapping, wherein said folding tab (33) is located on an exterior of the finished package; and e) then, rejecting the marked package (13) in a region of a discharge track (26) for completed packages (13).

3. The process as claimed in claim 2, wherein the inspecting step comprises contactlessly inspecting by a camera (48) the group (11) of assembled individual packages (10), which form the package contents, with respect to completeness in a region of a rearward side with respect to said direction of transport, the rearward side being formed from rearward faces of all cigarette packs (10) of the group (11).

4. The process as claimed in claim 3, further comprising the step of causing the group (13) to take along a wrapping blank, wherein the rearward side of the group (11) is inspected immediately before taking along the blank which forms the outer wrapping (12), or immediately after taking along the blank.

5. The process as claimed in claim 1 or 2, wherein the outer lower folding tab (33) is located on a rearward side wall of the package (13), with respect to said transport direction, and is folded over in a region of a corner, such that a corner portion is folded outward with an inner side of the wrapping, thereby forming an essentially triangular gusset (36).

6. The process as claimed in claim 5, further comprising the steps of placing the lower folding tab (33) in an inclined position, and producing the gusset (36) by folding during the folding of the lower folding tab (33) when said lower folding tab is located in the inclined position.

7. In an apparatus for production of packages (13) from individual cigarette packs which form a group (11), and from an outer wrapping (12) for the group, the outer wrapping being made from thin cardboard or paper, said groups being conveyed in a conveying direction, the improvement a) wherein each group (11) consists of at least one row of the individual packs, and extends transversely relative to said conveying direction of the groups (11); and comprising:

b) means for transporting the group (11) on a support (17), so that a blank for the outer wrapping (12), which blank is held ready in a plane transverse relative to the conveying direction of the group (11), is folded around the group (11) by a U-shaped folding movement, and taken along by the group;

c) means for inspecting the group (11), with respect to completeness of the group, by at least one contactless inspection means (48) that is directed towards a rearward, transversely directed side face of the group (11) relative to said conveying direction, wherein said side face is formed from faces of all the individual packs in the group (11);

d) for marking a package (13) identified as being defective, folding means for folding over a portion of the outer wrapping (12); and e) means for rejecting the defective package (13) from a feed stream of the packages in a region of a discharge track (26).

8. The apparatus as claimed in claim 7, comprising means for partly folding over a lower tab (33) in a region of a side wall of the outer wrapping (12), which side wall is a rearward wall with respect to said conveying direction, for marking a defective package (13) such that a part region of the lower tab (33) is directed outward with its inner side.

9. The apparatus as claimed in claim 8, further comprising folding means for folding over a gusset (36) of the lower tab (33), whereby an upwardly movable lower folding member (44) for the lower tab (33) interacts with a corner folding member (45) for the gusset (36) during an upward movement of the lower folding member, such that the gusset (36) of the lower tab (33) is folded against an outside of the lower folding member (44) as a result of a folding movement of the corner folding member (45) in a plane which is offset relative to the lower folding member (44).

10. The apparatus as claimed in claim 7, further comprising: a sensor (42), in a region of the discharge track (26), for detecting a marked package; and a pusher (37) for laterally ejecting the marked package.

11. The process as claimed in claim 1, wherein said contactless inspection means is a camera (48).

12. The apparatus as claimed in claim 7, wherein said contactless inspection means is a camera (48).

* * * * *